US005720630A

United States Patent [19]

Richmond et al.

[11] Patent Number: 5,720,630

[45] Date of Patent: Feb. 24, 1998

[54] ELECTRICAL CONNECTOR

[75] Inventors: Mark A. Richmond, Batavia; Frank B. Riordan, Prospect Heights; Charles W. Smaczny, River Grove, all of Ill.

[73] Assignee: Labinal Components and Systems, Inc., Elk Grove Village, Ill.

[21] Appl. No.: 606,551

[22] Filed: Feb. 26, 1996

Related U.S. Application Data

[63] Continuation of Ser. No. 505,599, Jul. 21, 1995, abandoned, which is a continuation of Ser. No. 120,721, Sep. 13, 1993, abandoned.

[51] Int. Cl.[6] ..... H01R 13/40

[52] U.S. Cl. ..... 439/591; 439/86

[58] Field of Search ..... 439/66, 86, 89, 439/91, 7, 599, 591, 600, 654

[56] References Cited

U.S. PATENT DOCUMENTS

| | | | |
|---|---|---|---|
| 2,962,688 | 11/1960 | Werner | 439/654 X |
| 3,281,558 | 10/1966 | Weber | 439/651 X |
| 3,324,445 | 6/1967 | Miller . | |
| 3,343,852 | 9/1967 | Blight et al. | 285/82 |
| 3,576,517 | 4/1971 | Johnson et al. . | |
| 3,648,002 | 3/1972 | Durocher | 439/91 X |
| 3,678,439 | 7/1972 | Vetter . | |
| 3,701,965 | 10/1972 | Durocher et al. | 439/91 X |
| 3,750,087 | 7/1973 | Vetter . | |
| 3,869,186 | 3/1975 | Vetter . | |
| 3,870,978 | 3/1975 | Dreyer | 439/86 X |
| 4,218,110 | 8/1980 | Giannaula et al. | 439/651 X |
| 4,229,064 | 10/1980 | Vetter et al. . | |
| 4,407,529 | 10/1983 | Holman | 285/82 |
| 4,423,919 | 1/1984 | Hillis . | |
| 4,460,238 | 7/1984 | Ireland . | |
| 4,703,986 | 11/1987 | McCormick | 439/607 |
| 4,820,184 | 4/1989 | Brandes | 439/321 |
| 4,820,207 | 4/1989 | Zic | 439/825 |
| 4,867,692 | 9/1989 | Kerek | 439/101 |
| 4,988,306 | 1/1991 | Hopfer, III et al. | 439/66 OR |
| 5,007,843 | 4/1991 | Smolley | 439/66 OR |
| 5,127,837 | 7/1992 | Shah et al. | 439/66 X |

FOREIGN PATENT DOCUMENTS

| | | |
|---|---|---|
| 0 348 562 | 1/1990 | European Pat. Off. . |
| WO 90/14750 | 11/1990 | WIPO . |

OTHER PUBLICATIONS

Catalog entitled "MIL–C–26500 Cylindricals" by Cinch Connector Division, a division of Labinal Components and Systems, Inc., Elk Grove Village, Illinois, U.S.A., Copyright 1990.

Catalog entitled "Vibra–Lok IV MIL–C–38999 Series IV" by Cinch Connector Division, a division of Labinal Components and Systems, Inc., Elk Grove Village, Illinois, U.S.A., Copyright 1990.

*Primary Examiner*—P. Austin Bradley
*Assistant Examiner*—Daniel Wittels
*Attorney, Agent, or Firm*—Leydig, Voit & Mayer, Ltd.

[57] ABSTRACT

An improved electrical connector for use in electronic assemblies to link electronic components in order to transmit electric signals or current. The connector includes a wafer interface connective construction with at least one resiliently compressible contact to provide a means across which electrical current can flow from one male pin to another male pin without placing the pins in direct contact with each other. The contact retains its form and resiliency through its non-compressive retainment within the aperture of the wafer interface connective construction. Engagement and disengagement of the connector is facilitated, yet reliability and conductivity are enhanced. Further, the size and weight of the connector is reduced, and the assembly of the connector is facilitated. In addition, the pin contacts and the retainment components for the pin contacts are common to both halves of the connector which eliminates the need for socket contacts and their associated components.

91 Claims, 3 Drawing Sheets

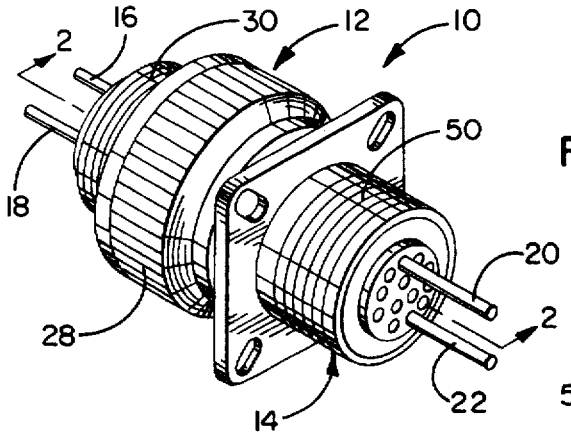
FIG. 1
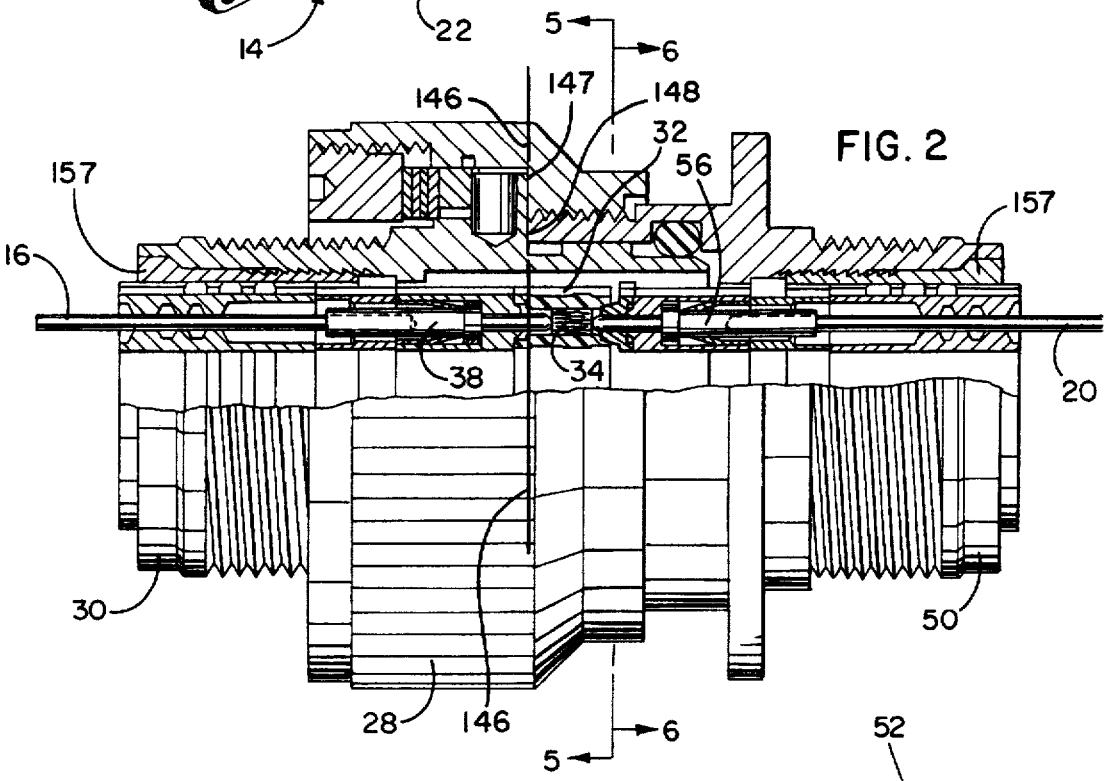
FIG. 2
FIG. 5
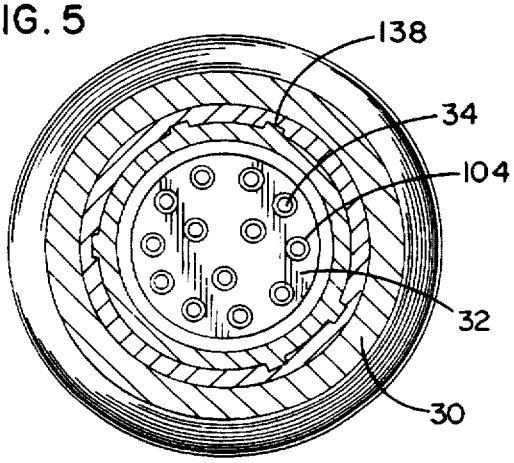
FIG. 6
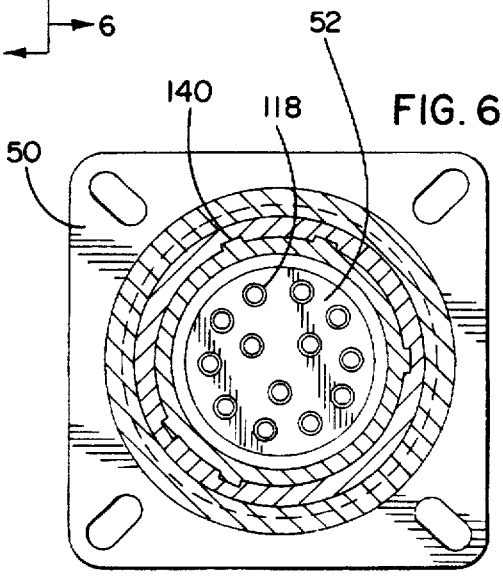

ELECTRICAL CONNECTOR

This application is a continuation of application Ser. No. 08/505,599 filed Jul. 21, 1995, now abandoned, which was a continuation of application Ser. No. 08/120,721 filed Sep. 13, 1993, now abandoned.

FIELD OF THE INVENTION

The present invention relates generally to electrical connectors and more particularly concerns electrical connector assemblies with wadded wire contacts, recessed in apertures in an interface module, for the transmission of electric current between male pins touching the wadded wire contact on opposite sides.

BACKGROUND OF THE INVENTION

Electronic assemblies generally require multiple electrical connections such that electrical signals and current can flow from either a power source or a component with electrical signals to other components of the assembly via wires and cables. In those electronic assemblies, and particularly those used in the air transportation industry, durable and reliable connections must be made between the electrical components in order to properly transmit electrical signals and current. Many different types of electrical connectors have been used or proposed in the prior art.

A common type of electrical connector is the pin and socket connector. Unfortunately, the pin and socket connector has been shown to have certain disadvantages. The pin and socket connector lacks the ability to provide efficient and reliable transmission of signals. Specifically, auxiliary contact area between the male and female contacts is critical to insure that a reliable connection is sustained in all conditions.

For example, under conditions of vibration, as is typical in the air transportation industry, the need for a large contact area between the male and female contacts is essential. If contact is lost along one point of the contact area due to vibration, the auxiliary contact area assures the existence of contact at other points of the contact area. In addition, the possible presence of impurities in the contact area accumulated either during the manufacturing process or from environmental exposure also compels the designer to increase the contact area to prevent an interruption in the flow of signals or current. The risk of improperly mating the assemblies generated by defects in the manufacturing process or by the deformation of the parts after frequent engagement and disengagement further aggravates the problem. Thus, a substantial surface area of contact is essential to maintain an uninterrupted flow of electrical signals or current through the connector.

Consequently, this enlarged contact surface area decreases the degree of design flexibility for the connectors. For instance, the number of connections that can be made through one connector assembly is severely limited. The greater space required by one connection leaves less room for other connections. Furthermore, if a specific number of connections are required for one connector assembly, then the size of the housing must be increased to accommodate the size of the surface area of the male and female members.

When the size of individual connections is increased, the weight of the connector assembly is increased correspondingly. Further, more connector assemblies are needed to effectuate the requisite number of connections due to the fewer number of connections that can be made on each electrical connector assembly. Thus, because each individual connection has increased weight and further because more connector assemblies are needed to complete the necessary connections for the system, the total weight of the connector assemblies in a system is increased. Naturally, weight is a significant concern in most industries and particularly in the air transportation industry.

A related disadvantage is that a comparatively high force is required to engage and disengage the connector assemblies. The engagement force is a function of the surface area of contact and the friction between the male and female contacts which, in turn, is a function of the tightness of the fit between those contacts. As previously noted, the surface area of contact must be sufficiently large to avoid any potential break in the continuity of the electrical connection. Furthermore, the frictional force between the contacts is generally high as well to ensure a stable connection.

Hence, the person coupling the connector assemblies must apply a significant force to engage the electrical contacts. Likewise, disengagement demands a significant force. The necessary insertion and disengagement forces are increased with multiple contacts by each additional electrical connection maintained through the connector assembly.

Furthermore, partially due to the necessary insertion force, the male pins can become bent if inserted erroneously. Subsequent insertion of the male pins into the female sockets is consequently inhibited. Another disadvantage is that the pins and sockets have relatively high electrical resistance.

SUMMARY OF THE INVENTION

It is the primary aim of the present invention to provide an electrical connector of decreased size and reduced weight while improving the integrity, durability and reliability of the electrical connection. Accordingly, providing environmental sealing from humidity and dust is a related object. Another related object is to provide means for the electrical connector to withstand vibration, particularly of the type common in aircraft.

Reducing the engagement and disengagement forces is another important objective. A related object of the invention is to provide guidance for the insertion of the pins. An additional object is to facilitate the manufacture and assembly of the connector, particularly with regard to the insertion of the contact into the interface module. Protecting the contact from wear and deformation is an additional objective.

Another object of the invention is to provide flexibility in the use of parts, but at the same time, prevent the mating of non-compatible connectors with the improved connector. A further object is to utilize existing wiring grommets, contact rear release clip retention systems and pin contact retention features currently defined and proven in U.S. government specifications, including but not limited to MIL-C-83723, MIL-C-38999 and MIL-C-39029. An additional object of the invention is to utilize standard wire crimping tools and insertion/removal tools, including but not limited to, the tools specified in U.S. government specification MIL-C-39029.

Other objects and advantages of the present invention and its details of construction will be apparent from a consideration of the following specification and accompanying drawings.

In accordance with the present invention, an improved electrical connector assembly is provided for linking an electrical line to another electrical line. The aforementioned objects are attained through the utilization of a resiliently compressible conductive contact recessed in the aperture of an interface module. The contact provides a means across which electric signals and current can flow from one male pin to another male pin without placing the pins into direct contact.

The connector assembly includes at least one contact retained within the aperture of an interface or contact module. The interface or contact module is attached to a retainment component with one or more openings therethrough at positions corresponding to the opening in the interface module. That retainment component is situated inside a shell connectable to a second shell.

An advantageous feature of this electrical connector and particularly the interface module is the reduction in diameter of the opening in the interface module from one end to the other end. The reduced diameter at the end of the opening which is exposed during use retains the contact within the interface module. In addition, assembly of the contact into the interface module is facilitated by the enlarged diameter in the opposite end of the opening in the interface module. The contact is held in place after the interface module is attached to the retainment component. Thus, the contact is trapped in the interface module. In addition, the junction between the retainment element and the interface module is sealed from environmental exposure by a protrusion around each opening in the retainment component that engages each opening in the interface module.

Further, to assure that the male pins contact the ends of the contact accurately, the connector assemblies use a "bottoming" design. The connector assemblies are designed to always connect with the shells of the assemblies directly contacting axially to ensure the same relative axial position of each connection. In other words, the connector assemblies are designed to invariably result with the assemblies in the same relative axial position. Utilizing a datum reference at the connection point between the connector assemblies further advances the accuracy of the connection.

BRIEF DESCRIPTION OF THE DRAWINGS

For a more complete understanding of this invention, reference should now be had to the embodiments illustrated in greater detail in the accompanying drawings.

FIG. 1 is a perspective view of the connector of this invention;

FIG. 2 is a partial cross-sectional view along line 2—2 of the connector shown in FIG. 1;

FIG. 5 is a cross-sectional view along line 5—5 of FIG. 2 showing the interface module; and, FIG. 6 is a cross-sectional view along line 6—6 of FIG. 2 showing the seal which mates with the interface module;

While the invention will be described in connection with certain preferred embodiments, it is not intended to limit the invention to those embodiments. On the contrary, it is intended to cover all alternatives, modifications and equivalents as may be included within the spirit and scope of the invention.

DETAILED DESCRIPTION OF THE PREFERRED EMBODIMENTS

Turning now to the drawings, FIG. 1 shows a perspective view of the preferred embodiment of the connector 10 of the present invention. The connector 10 comprises a receptacle 12 and a plug 14. As depicted in FIG. 1, the receptacle 12 is engaged with the plug 14. The receptacle 12 and plug 14 are designed to connect a group of wires 16, 18, 20, 22 which extend from the ends of the receptacle 12 and plug 14. In order to reduce the complexity of FIG. 1, only four of the wires are shown. However, in this embodiment, two sets of thirteen wires could be connected by the connector 10.

Figure 3:
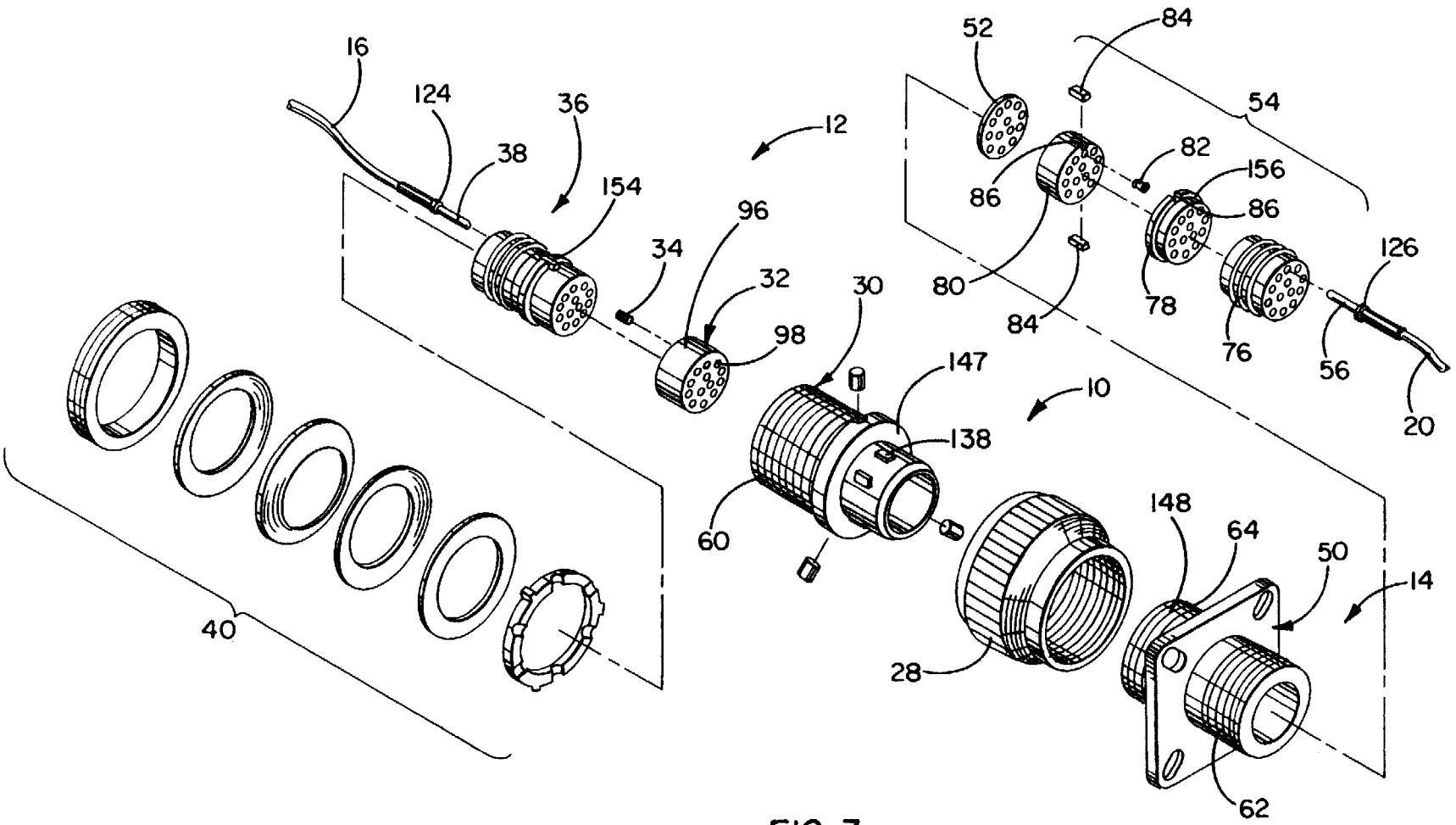
FIG. 3 is an exploded, perspective view of the connector.

Referring to FIG. 3, the receptacle 12 includes a coupling nut 28, receptacle shell 30, contact module 32, contact 34, retainment component 36, pins 38 and coupling nut attachment components 40. The plug 14 includes a plug shell 50, a face seal 52, retainment component 54 and pins 56.

FIG. 2 provides a partial cross-sectional view through one of the openings in the electrical connector 10. The wires 16, 20, are crimped or otherwise connected to the pins 38, 56. The pins 38 and 56 are shown inserted through the complementary openings in the receptacle 12 and plug 14. The pins 38, 56 protrude slightly into the contact module 32 and communicate with a resiliently compressible conductive contact 34 on opposite sides.

The shells 30, 50 can be made of metal, preferably aluminum, or a sturdy plastic material. The shells 30, 50 have threaded portions 60, 62 so that the shells 30, 50 can be attached to other components. In addition, the plug shell 50 has a threaded portion 64 which engages the interior threads of coupling nut 28. The coupling nut 28 is rotatably attached to the receptacle shell 30 by the coupling nut attachment components 40 which are known in the art of electrical connectors. Thus, the receptacle 12 is connected to the plug 14 by threading the coupling nut 28 onto the threaded portion 64 of the plug shell 50 until the coupling nut 28 is snug and the shells 30, 50 are "bottomed out". Of course, other coupling means which are known in the art of electrical connectors can be used to connect the shells, including but not limited to, bayonet coupling or lands and grooves coupling.

The shells 30, 50 contain the retainment components 36 and 54. The retainment components 36 and 54 include openings for the insertion of the pins 38 and 56 and wires 16, 20. The retainment components 36 and 54 may be a singular integral construction or preferably are composed of different combinations of parts designed for adjacent affixation.

In this particular embodiment, the retainment components 36, 54 are composed of several different parts. Furthermore, consistent with one of the advantageous features of this invention, the retainment component 36 for the receptacle 12 is identical to the retainment component 54 for the plug 14. Consequently, this feature greatly reduces the number of individual parts required for the connector 10. As shown in FIG. 3, the retainment component 36 is shown in the assembled state and the retainment component 54 is shown in the exploded state. Since both containment components 36, 54 are identical, only retainment component 54 will be described in detail.

Figure 4:
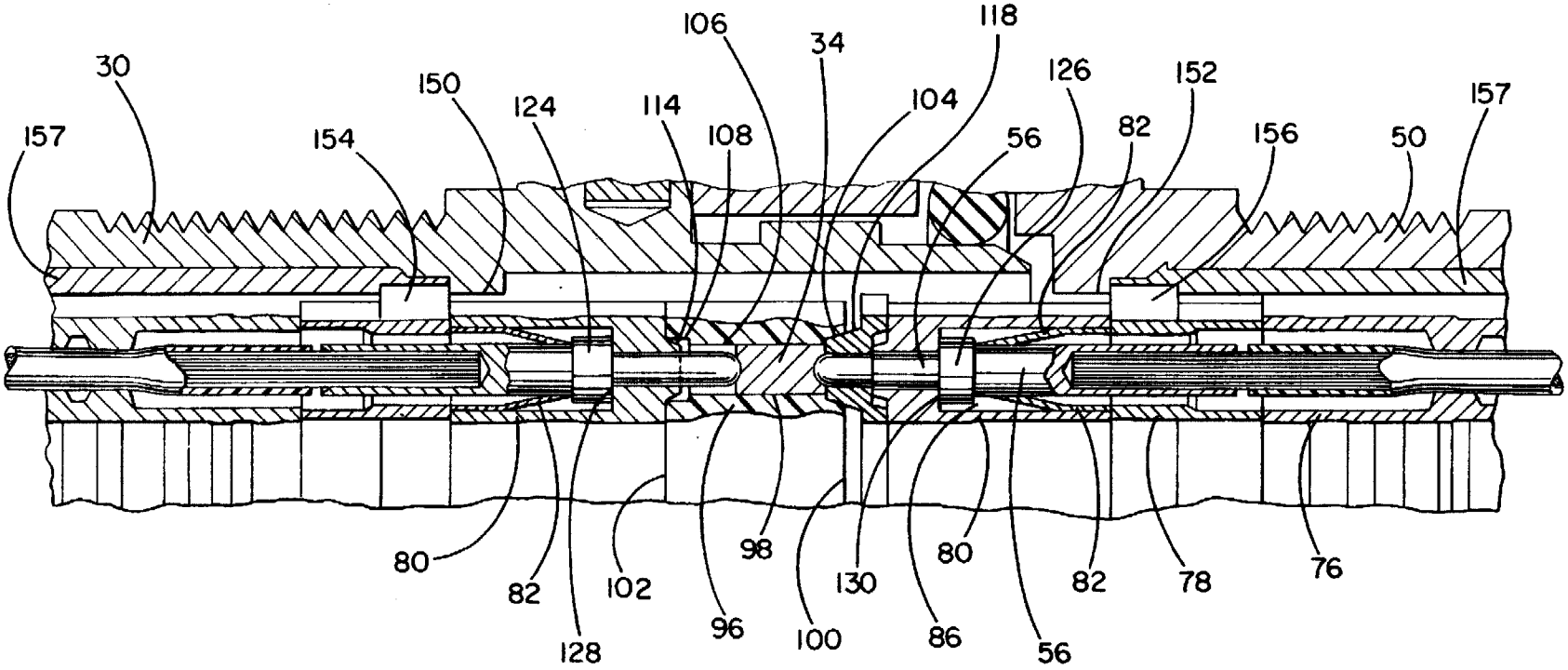
FIG. 4 is an enlarged partial view of FIG. 2.

Referring to FIGS. 3 and 4, retainment component 54 includes a grommet 76, rear insert half 78, front insert half 80, insert retaining clip 82, and two positioning inserts 84. The retaining clip 82 is positioned in an opening 86 between the rear insert 78 and the front insert 80. The rear insert 78 and the front insert 80 are then attached to each other by adhesive or other suitable means.

In order to properly align the apertures in the front and rear inserts 78, 80, two positioning inserts 84 are inserted into grooves 86 on the front and rear inserts 78, 80. The two positioning inserts 84 are then attached to the front and rear inserts by adhesive or other suitable means. After the front and rear inserts are attached to each other the retaining clip 82 is trapped between the front and rear inserts. At a later stage in the assembly process, the clip 82 in used to hold the pin 56 in a relatively fixed position.

In order to complete the retainment component 54, the grommet 76 is attached by adhesive or other means to the opposite face of the rear insert 78. Thus, the front insert 80, rear insert 78, retaining clips 82 the positioning inserts 84 and the grommet 76 are assembled to form the retainment component 54.

Each adjacent part should have the same number and configuration of openings for the retainment of the pins 36 and 54. Separation of the parts provides flexibility in the use of materials for the retainment components 36, 54. For example, the grommet 76 can be composed of a soft material to provide sealing with the shell. Specifically, the grommet 76 is made of a resilient elastomer. However, the front and rear inserts can be fabricated of a harder material in order to use positioning flanges as will be discussed later. Specifically, the front insert, rear insert and positioning inserts are made of rigid plastic. Other combinations of materials may additionally be employed without departing from the essence of the invention.

Interposed between the receptacle 12 and plug 14 is the interface or contact module 32 which includes contacts 34. The interface or contact module 32 is a cylindrical wafer 96 with at least one opening or aperture 98 therethrough. The interface module 32 is made of a rigid plastic. The contact 34 can be formed from a strand of a fine conductive metal wire wadded together to form a nearly cylindrical button. The wadded wire contact 34 may be of the type marketed by the Cinch Connector Division of Labinal Components and Systems, Inc., of Elk Grove Village, Ill., under the trademark CIN::APSE. Similar suitable buttons are available from other commercial sources.

Referring now to FIGS. 2, 3 and 4 the interface or contact module 32 includes at least one aperture 98 through its thickness, but typically there are a plurality of apertures. Each aperture is defined by electrically insulated material. The aperture 98 in the interface module 32 has several different interior portions and extends from a first face surface 100 of the interface module 32 to a second face surface 102.

Referring to FIG. 4, the aperture 32 has a chamfered portion 104 extending from the first face surface 100. As will be discussed later, the chamfered portion 104 will be used in conjunction with the seal 52 to create an environmental seal for the connections. Moving to the left in FIG. 4, the next portion of the aperture 98 is a tapered or conical portion 106. Although the tapered portion 106 appears to be cylindrical in FIG. 4, the diameter of the aperture is greater at the left end of tapered portion 106 and gradually reduces in diameter at the right end of tapered portion 106. The diameter at the left end is slightly larger that the diameter of the contact 34. The diameter at the right end is slightly smaller than the diameter of the contact 34.

This tapered portion 106 has several advantages. First, the tapered portion 106 facilitates the insertion of the contacts 34 into the aperture 98 because the diameter at the left end is larger than the contacts 34. Second, the tapered portion 106 prevents the contacts 34 from exiting the right end of the aperture 98 because the diameter at the right end is smaller than the diameter of the contacts 34. Consequently, as will be discussed later the tapered surface 106 allows the contacts 34 to be held in the apertures 98 without the risk of accidentally exiting the aperture 98.

A third advantage is that the contact 34 loosely fits within aperture 98 and is free to slide within the aperture 98. This freedom of movement eliminates some of the problems associated with compressive engagement of the contacts in the apertures. Impairment in the degree of resiliency in the contact 34 caused by compressive engagement is prevented. Second, because the contact 34 may move when the pins 38 and 56 touch the contact 34, the centering of the contact 34 within the aperture 98 is not critical. Furthermore, the loose fit between the contact 34 and the aperture 98 removes potential variances in the compressive engagement of the multiple wire strand elements making up the contact end surface and removes the attendant unpredictability of the electrical resistance.

Finally, moving further to the left in FIG. 4, the next portion of aperture 98 is a recessed cylindrical or stepped portion 108. The stepped portion 108 has a diameter which is larger than the tapered portion 106. In assembly, the insertion of the contacts 34 in the interface module 32 is facilitated by the larger diameter stepped portion 108. While depicted in the drawing as stepped, this recessed portion 108 can alternatively be chamfered to guide the insertion of the contact 34 into the aperture 98. In addition, as will be discussed later, this stepped portion 108 facilitates the assembly and alignment of the apertures of the interface module 32 to the retainment component 36.

After the contact 34 is inserted into aperture 98, the interface module 32 is adhered or otherwise attached to the retainment component 36, or more specifically, the front insert half 80. The retainment component 36 preferably has at least one protrusion 114 which fits into the stepped portion 108. The inside diameter of this protrusion 114 is smaller than the diameter of the contact 34. Thus, while the contact 34 can be easily inserted into the aperture 98 of the interface module 32, the retainment component 36 prevents the contact 34 from exiting the aperture 98 after assembly.

On the right side of the aperture 98, a reduced diameter area prevents the contact 34 from moving beyond the point where the diameter of aperture 98 is less than the diameter of the contact 34. Accordingly, the contact 34 is trapped in this aperture 98. Moreover, this entrapment is effectuated without any radial force exerted upon the contact 34.

As noted earlier, the aperture 98 includes a chamfered portion 104. This chamfered portion 104 forms a slope which guides the pin 56 into the proper position for protrusion into contact 34 when the receptacle 12 and plug 14 are engaged. A malleable protrusion 118 on retainment component 54 engages the walls of the chamfered portion 104 of the interface module 32 to form a seal. This seal is in the nature of a "cork and bottle" and protects the area of electrical contact from the environment.

It is to be appreciated that the protrusion 118 may be integral with retainment component 54 or be attached as a separate face seal 52. A separate face seal 52 offers added interchangeability in the parts. The face seal 52 is made of a resilient elastomer. The dimensioning of the retainment components 36, 54 of the connector assembly can intentionally be symmetric. Consequently, the retainment components 36, 54 can be used interchangeably with either the receptacle 12 or plug 14.

Another advantageous feature is that the male pins 38 and 56 protrude into the contact 34 on opposite sides without overly compressing it. The pins 38 and 56 are designed with flange areas 124 and 126 which engage abutment recesses 128 and 130 in the retainment components 36, 54. In addition, the flange areas 124, 126 on the pins engage the retaining clips 82. During assembly, the pins 38, 56 are attached to the individual wires 16, 20. Then the pins 38, 56 are inserted into the apertures in the retainment components 36, 54 until the flange areas 124, 126 of the pins engage the abutment recesses 128, 130. As the pins 38, 56 are inserted into the apertures, the retaining clips 82 engage the flange areas 124, 126 and prevent the pins 38, 56 from being removed from the apertures. Consequently, the pins 38, 56 are held in a relatively fixed position.

Therefore, when the receptacle 12 and plug 14 are engaged with each other, the pins 38 and 56 can be inserted sufficiently to contact and protrude slightly into the contact 34 as shown in FIG. 4, but the abutment recesses 128 and 130 will obstruct forward movement beyond this point by engaging the flanges 124 and 126.

As can be seen, another advantageous feature of the invention is that the pin contacts and the retainment components are common to both the receptacle and the plug. Consequently, this connector eliminates the need for socket contacts and their associated retainment components. Furthermore, the connector uses standard wire crimping tools and insertion/removal tools, including but not limited to, the tools specified in U.S. government specification MIL-C-39029.

FIGS. 3, 4, 5 and 6 illustrate another advantageous feature of this invention that aids in the prevention of axial compression on contact 34. The shells 30, 50 are designed to "bottom out" when connected in order to consistently be in the same exact axial relationship when connected. When the receptacle 12 and plug 14 are engaged to be connected, the plug 12 moves into the receptacle 14 until the shell 30 of the plug 12 directly contacts with the shell 50 of the receptacle 14. In conjunction with the positioning features discussed subsequently, this "bottoming" of the receptacle 12 and plug 14 ensures that the male pins 38 and 56 reliably touch the contact 34 and do so without excessive compression.

The "bottoming out" can be performed by several means. For example, predetermined threading on the shells 30, 50 in conjunction with the use of keys 138 and notches 140 will assure that the connectors unite precisely. The keys 138 and notches 140 assure that the starting point of the coupling is always at the same location on the threading. FIGS. 5 and 6 illustrate the matching keys 138 and notches 140. In addition, the accuracy of the alignment of the openings between the receptacle 12 and the plug 14 will also be ensured by these keys 138 and notches 140.

Axial alignment can alternatively be achieved by the utilization of flanges situated on the shells 30, 50 at predetermined positions. When the flanges are clipped, pinned or screwed together, the shells 30, 50 are consequently forced to meet in the same axial position. Thus, this invention provides for the conduction of an electrical signal or current from a male pin 38 through the contact 34 to the male pin 56 without undue axial compression of the contact 34.

Furthermore, referring back to FIG. 2, in the manufacturing and assembly process, drawings with datums located at the point of attachment, plane 146, between the edges 147, 148 of the shells 30, 50 are utilized. As all measurements are taken from this datum point 146 where the "bottoming out" occurs, a large tolerance build-up in the critical axially positioning feature is prevented. Indeed, no tolerance build-up will exist at the point of contact and "bottoming" of the connector halves is accordingly assured.

Further, when the receptacle 12 and plug 14 are engaged as shown in FIG. 4, the annular shelves 150 and 152 on the interior of shells 30, 50 are an accurate distance from each other. These shelves 150 and 152 axially position the retainment components 36 and 54 by contacting the flanges 154, 156 on the retainment components 36, 54. The accurate positioning of the retainment components 36, 54 will then accurately position the flanges 124, 126 on the pins. The flanges 124, 126 determine the axial position of the pins 38 and 56 with respect to the contact 34. The precise positioning of these components assure that the pins 38 and 56 touch the contact 34 without undue compression.

While the annular shelves 150 and 152 obstruct the retainment components 36 and 54 from forward movement, a sealing material 157 is positioned between the interior of the shells 30, 50 and the retainment components 35 and 54 which functions as an adhesive and as a seal against the environment. The sealing material is a silicone-based adhesive.

Additional advantageous features of this invention are the reduction in the frequency of bent pins and external contact with the pins and contacts. Referring to FIG. 4, the pins 38 in the receptacle 12 are not exposed and the contacts 34 are housed internally in the interface or contact module 32. Consequently, the pins 38 and contacts 34 are protected from external contact. Furthermore, in the plug 14, the pins 56 protrude slightly beyond the seal 52. Consequently, if the user misaligns the receptacle 12 and plug 14, it is unlikely that the user will bend the pins 56.

It will be appreciated, of course, that the foregoing arrangement is also suitable for non-cylindrical connectors. For example, the receptacle, the plug, the retainment components and the interface module can be rectangular in cross-section.

What is claimed is:

1. An electrical connector comprising:

two mateable connector assemblies for joining to one another and having mating faces to be disposed in opposed relation to one another when said connector assemblies are joined;

each of said connector assemblies including at least one bore therethrough retaining a conductive pin for connection to a wire, said pin having an abutment portion protruding from said mating face of the respective connector assembly; and an interface connective construction between said opposed mating faces and having at least one aperture therethrough with end openings in alignment with said bores, said at least one aperture being defined by electrically insulative material, and a resiliently compressible conductive wadded wire contact disposed in a freely movable fashion within said at least one aperture for resiliently engaging said aligned pin portions in conductive contact relation when said abutment portions are inserted through the respective opening of said aperture whereby an electrically conductive path is established between said aligned pin portions through the respective aperture when said connector assemblies are joined in mating relations with one another.

2. The invention as in claim 1 wherein said interface connective construction contains a plurality of apertures, each retaining a conductive contact;

said first connector assembly contains a plurality of pins in positions corresponding to the position of the apertures of said interface connective construction; and said second connector assembly contains a plurality of pins in positions corresponding to the position of the apertures of said interface connective construction.

3. The invention as in claim 1 wherein the aperture of said interface connective construction includes an area of reduced size at one end of the aperture smaller than the conductive contact.

4. The invention as in claim 1 wherein a malleable material is located between one of said connector assemblies and said interface connective construction to form a seal.

5. The invention as in claim 1 wherein the connector assembly includes an opening with a diameter smaller than the diameter of the conductive contact.

6. The invention as in claim 1 wherein the aperture walls are tapered inward.

7. The invention as in claim 1 wherein said aperture includes an area near the face of said interface connective construction which is stepped.

8. The invention as in claim 1 wherein said aperture includes an area near the face of said interface connective construction which is chamfered.

9. The invention as in claim 1 wherein one of said connector assemblies includes a protrusion on its mating face, in which the conductive pin is contained, for each aperture of said interface connective construction on the second mating connector assembly, formed of a malleable material such that the protrusion fits in the aperture to form a seal.

10. The invention as in claim 1 wherein each of said connector assemblies includes a retainment element and said retainment elements are identical in configuration.

11. The invention as in claim 1 wherein said contact is recessed from one of said faces of the interface connective construction.

12. The invention as in claim 1 wherein said pins are identical in configuration.

13. The invention as in claim 1, wherein at least one of the connector assemblies comprises a retainment element and an outer casing shell.

14. The invention as in claim 1, wherein at least one of the connector assemblies comprises a retainment element, an outer shell and a sealing material interposed between the shell and the retainment element.

15. The invention as in claim 13 wherein said shell is made of metal.

16. The invention as in claim 13 wherein said shell is made of plastic.

17. The invention as in claim 1 wherein the connector assemblies include a means for connecting the two assemblies consistently at the same relative axial position.

18. The invention as in claim 1 wherein the connector assemblies are correspondingly threaded and the connection between the connector assemblies is made by screwing the connector assemblies together.

19. The invention as in claim 1 wherein the connector assemblies have flanges and the connection between the connector assemblies is made by securing the flanges together.

20. The invention as in claim 19 wherein the flanges have complementary holes and the connection between the connector assemblies is effected by the insertion of a pin through the flange holes.

21. The invention as in claim 19 wherein the flanges have complementary threaded holes and the connection between the connector assemblies is by means of a screw through the flange holes.

22. The invention as in claim 1 wherein said mating faces are circular in shape.

23. The invention as in claim 1 wherein said connector assemblies include a key and a notch that permit connection of the connector assemblies in a predetermined configuration.

24. An electrical connector comprising:

two mateable connector assemblies for joining to one another and having mating faces to be disposed in opposed relation to one another when said connector assemblies are joined;

each of said connector assemblies including at least one bore therethrough retaining a conductive pin for connection to a wire, said pin having an abutment portion protruding from said mating face of the respective connector assembly; and an interface connective construction between said opposed mating faces and having at least one aperture therethrough with end openings in alignment with said bores, said at least one aperture being defined by electrically insulative material, and a resiliently compressible conductive wadded wire contact disposed within said at least one aperture for resiliently engaging said aligned pin portions in conductive contact relation when said abutment portions are inserted through the respective opening of said aperture whereby an electrically conductive path is established between said aligned pin portions through the respective aperture when said connector assemblies are joined in mating relations with one another, the aperture of said interface connective construction including an area of reduced size at one end of the aperture smaller than the conductive contact whereby the area of reduced size retains said contact within the aperture.

25. The invention as in claim 24 wherein said interface connective construction contains a plurality of apertures, each retaining a conductive contact;

said first connector assembly contains a plurality of pins in positions corresponding to the position of the apertures of said interface connective construction; and said second connector assembly contains a plurality of pins in positions corresponding to the position of the apertures of said interface connective construction.

26. The invention as in claim 24 wherein a malleable material is located between one of said connector assemblies and said interface connective construction to form a seal.

27. The invention as in claim 24 wherein the connector assembly includes an opening with a diameter smaller than the diameter of the conductive contact.

28. The invention as in claim 24 wherein the aperture walls are tapered inward.

29. The invention as in claim 24 wherein said aperture includes an area near the face of said interface connective construction which is stepped.

30. The invention as in claim 24 wherein said aperture includes an area near the face of said interface connective construction which is chamfered.

31. The invention as in claim 24 wherein one of said connector assemblies includes a protrusion on its mating face, in which the conductive pin is contained, for each aperture of said interface connective construction on the second mating connector assembly, formed of a malleable material such that the protrusion fits in the aperture to form a seal.

32. The invention as in claim 24 wherein said contact is recessed from one of said faces of the interface connective construction.

33. The invention as in claim 24 wherein said pins are identical in configuration.

34. The invention as in claim 24, wherein at least one of the connector assemblies comprises a retainment element and an outer casing shell.

35. The invention as in claim 24, wherein at least one of the connector assemblies comprises a retainment element, an outer shell and a sealing material interposed between the shell and the retainment element.

36. The invention as in claim 34 wherein said shell is made of metal.

37. The invention as in claim 34 wherein said shell is made of plastic.

38. The invention as in claim 24 wherein the connector assemblies include a means for connecting the two assemblies consistently at the same relative axial position.

39. The invention as in claim 24 wherein the connector assemblies are correspondingly threaded and the connection between the connector assemblies is made by screwing the connector assemblies together.

40. The invention as in claim 24 wherein the connector assemblies have flanges and the connection between the connector assemblies is made by securing the flanges together.

41. The invention as in claim 40 wherein the flanges have complementary holes and the connection between the connector assemblies is effected by the insertion of a pin through the flange holes.

42. The invention as in claim 40 wherein the flanges have complementary threaded holes and the connection between the connector assemblies is by means of a screw through the flange holes.

43. The invention as in claim 24 wherein said mating faces are circular in shape.

44. The invention as in claim 24 wherein said connector assemblies include a key and a notch that permit connection of the connector assemblies in a predetermined configuration.

45. An electrical connector comprising:

two mateable connector assemblies for joining to one another and having mating faces to be disposed in opposed relation to one another when said connector assemblies are joined;

each of said connector assemblies including at least one bore therethrough retaining a conductive pin for connection to a wire, said pin having an abutment portion protruding from said mating face of the respective connector assembly; and an interface connective construction between said opposed mating faces and having at least one aperture therethrough with end openings in alignment with said bores, said at least one aperture being defined by electrically insulative material, and a resiliently compressible conductive wadded wire contact disposed within said at least one aperture for resiliently engaging said aligned pin portions in conductive contact relation when said abutment portions are inserted through the respective opening of said aperture conductive path is established between said aligned pin portions through the respective aperture when said connector assemblies are joined in mating relations with one another, said contact having a first cross-section, said interface connective construction aperture having a second cross-section greater than the first cross-section through the central portion of the aperture.

46. The invention as in claim 45 wherein said aperture includes an area near the face of said interface connective construction which is stepped.

47. The invention as in claim 45 wherein the aperture walls are tapered inward.

48. The invention as in claim 45 wherein said aperture includes an area near the face of said interface connective construction which is chamfered.

49. The invention as in claim 45 wherein one of said connector assemblies includes a protrusion on its mating face, in which the conductive pin is contained, for each aperture of said interface connective construction on the second mating connector assembly, formed of malleable material such that the protrusion fits in the aperture to form a seal.

50. The invention as in claim 45 wherein the connector assembly includes an opening with a diameter smaller than the diameter of the conductive contact.

51. The invention as in claim 45 wherein said interface connective construction contains a plurality of apertures each retaining a conductive contact;

said first connector assembly contains a plurality of pins in positions corresponding to the position of the apertures of said interface connective construction; and said second connector assembly contains a plurality of pins in positions corresponding to the position of the apertures of the said interface connective construction.

52. The invention as in claim 45 wherein said connector assemblies include a key and a notch that permit connection of the connector assemblies in one predetermined configuration.

53. The invention as in claim 45 wherein at least one of the connector assemblies comprises a retainment component and an outer casing shell.

54. The invention as in claim 45 wherein at least one of the connector assemblies comprises a retainment element, an outer shell and a sealing material interposed between the shell and the retainment element.

55. The invention as in claim 53 wherein said shell is made of metal.

56. The invention as in claim 53 wherein said shell is made of plastic.

57. The invention as in claim 45 wherein the connector assemblies include a means for connecting the two assemblies consistently at the same relative axial position.

58. The invention as in claim 45 wherein the connector assemblies are correspondingly threaded and the connection between the connector assemblies is made by screwing the connector assemblies together.

59. The invention as in claim 45 wherein the connector assemblies have flanges and the connection between the connector assemblies is made by securably adjoining the flanges together.

60. The invention as in claim 59 wherein the flanges have complementary holes and the connection between the connector assemblies is effected by the insertion of a pin through the flange holes.

61. The invention as in claim 59 wherein the flanges have complementary threaded holes and the connection between the connector assemblies is by means of a screw through the flange holes.

62. The invention as in claim 45 wherein said mating faces are circular in shape.

63. The invention as in claim 45 wherein a malleable material is located between one of said connector assemblies and said interface connective construction to form a seal.

64. The invention as in claim 45 wherein the aperture of said interface connective construction includes an area of reduced size at one end of the aperture smaller than the conductive contact.

65. The invention as in claim 45 wherein said contact is recessed from one of said faces of the interface connective construction.

66. The invention as in claim 45 wherein said pins are identical in configuration.

67. The invention as in claim 45 wherein each of said connector assemblies includes a retainment element and said retainment elements are identical in configuration.

68. The invention as in claim 45 wherein each of said connector assemblies includes a retainment element and said retainment elements are identical in configuration.

69. An electrical connector comprising:

two mateable connector assemblies for joining to one another and having mating faces to be disposed in opposed relation to one another when said connector assemblies are joined;

each of said connector assemblies including at least one bore therethrough retaining a conductive pin for connection to a wire, said pin having an abutment portion protruding from said mating face of the respective connector assembly; and an interface connective construction between said opposed mating faces and having at least one aperture therethrough with end openings in alignment with said bores, said at least one aperture being defined by electrically insulative material, and a resiliently compressible conductive contact disposed within, and is freely moveable within, said at least one aperture for resiliently engaging said aligned pin portions in conductive contact relation when said abutment portions are inserted through the respective opening of said aperture whereby an electrically conductive path is established between said aligned pin portions through the respective aperture when said connector assemblies are joined in mating relations with one another.

70. The invention as in claim 69 wherein the aperture of said interface connective construction includes an area of reduced size at one end of the aperture smaller than the conductive contact.

71. The invention as in claim 70 wherein the aperture walls are tapered inward.

72. The invention as in claim 69 wherein said aperture includes an area near the face of said interface connective construction which is chamfered.

73. The invention as in claim 69 wherein one of said connector assemblies includes a protrusion on its mating face, in which the conductive pin is contained, for each aperture of said interface connective construction on the second mating connector assembly, formed of malleable material such that the protrusion fits in the aperture to form a seal.

74. The invention as in claim 69 wherein said interface connective construction contains a plurality of apertures each retaining a conductive contact;

said first connector assembly contains a plurality of pins in positions corresponding to the position of the apertures of said interface connective construction; and said second connector assembly contains a plurality of pins in position corresponding to the positions of the apertures of said interface connective construction.

75. The invention as in claim 69 wherein said aperture includes an area near the face of said interface connective construction which is stepped.

76. The invention as in claim 69 wherein said contact is recessed from one of said faces of the interface connective construction.

77. The invention as in claim 69 wherein said pins are identical in configuration.

78. The invention as in claim 69 wherein each of said connector assemblies includes a retainment element and said retainment elements are identical in configuration.

79. The invention as in claim 69, wherein said connector assemblies include a key and a notch that permit connection of the connector assemblies in predetermined configuration.

80. The invention as in claim 69, wherein at least one of the connector assemblies comprises a retainment element and an outer casing shell.

81. The invention as in claim 69, wherein at least one of the connector assemblies comprises a retainment element, an outer shell and a sealing material interposed between the shell and the retainment element.

82. The invention as in claim 80 wherein said shell is made of metal.

83. The invention as in claim 80 wherein said shell is made of plastic.

84. The invention as in claim 69 wherein the connector assemblies include a means for connecting the two assemblies consistently at the same relative axial position.

85. The invention as in claim 69 wherein the connector assemblies are correspondingly threaded and the connection between the connector assemblies is made by screwing the connector assemblies together.

86. The invention as in claim 69 wherein the connector assemblies have flanges and the connection between the connector assemblies is made by securing the flanges together.

87. The invention as in claim 86 wherein the flanges have complementary holes and the connection between the connector assemblies is effected by the insertion of a pin through the flange holes.

88. The invention as in claim 86 wherein the flanges have complementary threaded holes and the connection between the connector assemblies is by means of a screw through the flange holes.

89. The invention as in claim 69 wherein said mating faces are circular in shape.

90. The invention as in claim 69 wherein the connector assembly includes an opening with a diameter smaller than the diameter of the conductive contact.

91. The invention as in claim 69 wherein a malleable material is located between one of said connector assemblies and said interface connective construction to form a seal.

* * * * *

UNITED STATES PATENT AND TRADEMARK OFFICE

CERTIFICATE OF CORRECTION

PATENT NO. : 5,720,630

DATED : February 24, 1998

INVENTOR(S) : Richmond et al.

It is certified that error appears in the above-identified patent and that said Letters Patent is hereby corrected as shown below:

In Claim 45, Column 11, line 52: "aperture conductive" should read --aperture whereby an electrically conductive--.

Signed and Sealed this

Twenty-sixth Day of May, 1998

*Attest:*

Bruce Lehman

BRUCE LEHMAN

*Attesting Officer*

*Commissioner of Patents and Trademarks*